US006488481B1

(12) United States Patent
Nagai et al.

(10) Patent No.: US 6,488,481 B1
(45) Date of Patent: Dec. 3, 2002

(54) COMPRESSOR WITH SUCTION MUFFLER STRUCTURE

(75) Inventors: Hiroyuki Nagai, Kariya (JP); Kazushige Murao, Kariya (JP); Kazuaki Iwama, Kariya (JP); Hiroshi Kamishima, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/503,811

(22) Filed: Feb. 15, 2000

(30) Foreign Application Priority Data

Mar. 1, 1999 (JP) ..... 11-052493

(51) Int. Cl.[7] ..... F04B 39/00
(52) U.S. Cl. ..... 417/312; 417/540; 417/543
(58) Field of Search ..... 417/312, 540, 417/543

(56) References Cited

U.S. PATENT DOCUMENTS

| | | | | |
|---|---|---|---|---|
| 4,019,342 A | | 4/1977 | Ohta | 62/469 |
| 4,221,544 A | | 9/1980 | Ohta | 417/269 |
| 4,793,775 A | | 12/1988 | Peruzzi | 417/312 |
| 5,496,156 A | * | 3/1996 | Harper et al. | 417/312 |
| 5,556,260 A | | 9/1996 | Takenaka et al. | 417/269 |
| 5,850,743 A | | 12/1998 | Dreiman et al. | 62/503 |
| 5,888,055 A | * | 3/1999 | Lee | 417/312 |
| 5,938,411 A | * | 8/1999 | Seo | 417/312 |
| 5,971,720 A | * | 10/1999 | Fagotti et al. | 417/312 |
| 5,988,990 A | * | 11/1999 | Lee | 417/312 |
| 6,129,522 A | * | 10/2000 | Seo | 417/312 |
| 6,149,402 A | * | 11/2000 | Kim | 417/312 |

FOREIGN PATENT DOCUMENTS

JP 7-139463 A 5/1995

OTHER PUBLICATIONS

EP 00 10 3132 Search Report dated Jul. 11, 2000.

* cited by examiner

*Primary Examiner*—Charles G. Freay
*Assistant Examiner*—William H Rodriguez
(74) *Attorney, Agent, or Firm*—Woodcock Washburn LLP

(57) ABSTRACT

A compressor has a suction muffler structure capable of reducing vibration and noise accompanying liquid compression. The suction muffler structure involves a muffler chamber defined between a suction chamber of the compressor and an external coolant circuit. A suction passage connects the muffler chamber to the suction chamber. A liquid-storage space is formed in the region of the muffler chamber lower than the inlet of the suction passage to the muffler chamber.

10 Claims, 5 Drawing Sheets

COMPRESSOR WITH SUCTION MUFFLER STRUCTURE

BACKGROUND OF THE INVENTION

1. Field of the Invention

The present invention relates to a compressor for, for example, a vehicle air-conditioner and, in particular, to a compressor having a suction muffler structure for damping a pressure pulsation in a coolant gas sucked from an external coolant circuit.

2. Description of the Related Art

A suction muffler structure of the above-mentioned type is disclosed, for example, in Japanese Unexamined Patent Publication (Kokai) No. 7-139463. That is, as shown in FIG. 6, a compressor is adapted to repeat a compression cycle comprising the suction of a coolant gas from a suction chamber 102 to a compression chamber 103, the compression of the sucked coolant gas and the discharge of the compressed coolant gas to a discharge chamber 104 by a reciprocation of a piston 101 in the horizontal directions as seen in the drawing. A muffler chamber 105 is formed between an external coolant circuit and the suction chamber 102. Accordingly, a pressure pulsation of the coolant gas sucked from the external coolant circuit into the compression chamber 103 is damped due to an expansion type muffler action of the muffler chamber 105, whereby the vibration or noise generated in a piping of the external coolant circuit due to this pressure pulsation can be reduced.

Generally, a vehicle air-conditioner has a compressor often disposed at the lowest position in a refrigeration circuit because the compressor is driven by a vehicle engine which is located at a lower position in a vehicle body. Therefore, the liquid coolant in the external coolant circuit is liable to flow into the compressor while the vehicle is stopped due to the height difference, and if the vehicle is stopped for a long time, the suction chamber 102, the muffler chamber 105 and the suction passage 106 are almost filled with the liquid coolant before the compressor is restarted.

In the suction muffler structure shown in FIG. 6, an inlet 107 of one of a plurality of suction passages 106 connecting the muffler chamber 105 to the suction chamber 102 opens at the lowermost position thereof. That is, the muffler chamber 105 has almost no volume in a region lower than the inlet 107 to the lowest suction passage 106. Accordingly, there is a problem that liquid compression continues for a long time because the liquid coolant in the muffler chamber 105 moves to the suction chamber 102 in a liquid phase, resulting in increase in vibration and noise caused by the liquid compression.

SUMMARY OF THE INVENTION

An object of the present invention is to solve the above-mentioned problems of the prior art and to provide a compressor having a suction muffler structure which is capable of reducing generation of vibration and noise due to the liquid compression.

To achieve the above object, there is provided a compressor, according to the invention, comprising a housing having a compression chamber and a suction chamber defined adjacent to each other in the housing, a movable member associated with the compression chamber so that a coolant gas is sucked from the suction chamber into the compression chamber, compressed in the compression chamber and discharged from the compression chamber, and a suction muffler structure. The suction muffler structure comprises a muffler chamber provided between the suction chamber and an external coolant circuit, a suction passage connecting the muffler chamber to the suction chamber, the suction passage having an inlet from the muffler chamber, and the muffler chamber having a liquid-storage space formed in a region in the muffler chamber lower than the inlet.

According to the invention as described above, the liquid coolant flowing, for example, from the external coolant circuit into the muffler chamber is temporarily stored in the liquid-storage space. Since the inlet to the suction passage is provided at a position above the liquid-storage space, the liquid coolant in the liquid-storage space hardly moves to the suction chamber via the suction passage while in a liquid phase. The liquid coolant in the liquid-storage space is evaporated by the heat generation of the compressor during the operation thereof and finally moves to the suction chamber in a gas phase. Accordingly, it is possible to reduce generation of vibration and noise accompanied with the liquid compression.

Preferably, the muffler chamber is formed by a muffler housing attached to the housing of the compressor and a muffler cover fixedly secured to the muffler housing at a parting line so as to extend partly in the muffler housing and partly in the muffler cover, the suction passage being formed in one of the muffler housing and the muffler cover to extend to the muffler chamber, the inlet being disposed at a position not exceeding the parting line between the muffler housing and the muffler cover.

In this feature, the structure forming the inlet of the muffler chamber to the suction path is disposed at a position not exceeding the abutment line between the muffler housing and the muffler cover. Therefore, a grinding operation is not disturbed by the structure forming the inlet, whereby it is possible to prevent the workability from deteriorating when a surface of the muffler housing or the muffler cover to be in contact with the corresponding surface of the other is ground.

Preferably, the inlet from the muffler chamber to the suction passage opens upward or downward.

For example, if the inlet of the muffler chamber to the suction path opens laterally, there might be a height difference in the inlet corresponding to a diameter thereof. Therefore, a volume for a liquid-storage space would be reduced. Contrarily, according to the invention defined by claim 3, the inlet to the suction path opens either upward or downward in the muffler chamber. Therefore, there is no height difference in the inlet to ensure the liquid-storage space of a larger volume.

Preferably, the muffler housing has an outer wall to partly form the muffler chamber and a tubular wall in the outer wall to form the suction passage.

BRIEF DESCRIPTION OF THE DRAWINGS

The present invention will become more apparent from the following description of the preferred embodiments, with reference to the accompanying drawings, in which.

DESCRIPTION OF THE PREFERRED EMBODIMENTS

The present invention will be described with reference to an embodiment of a suction muffler structure for a piston type compressor constituting a vehicle air-conditioner.

First, a structure of a compressor will be described.

Figure 1:
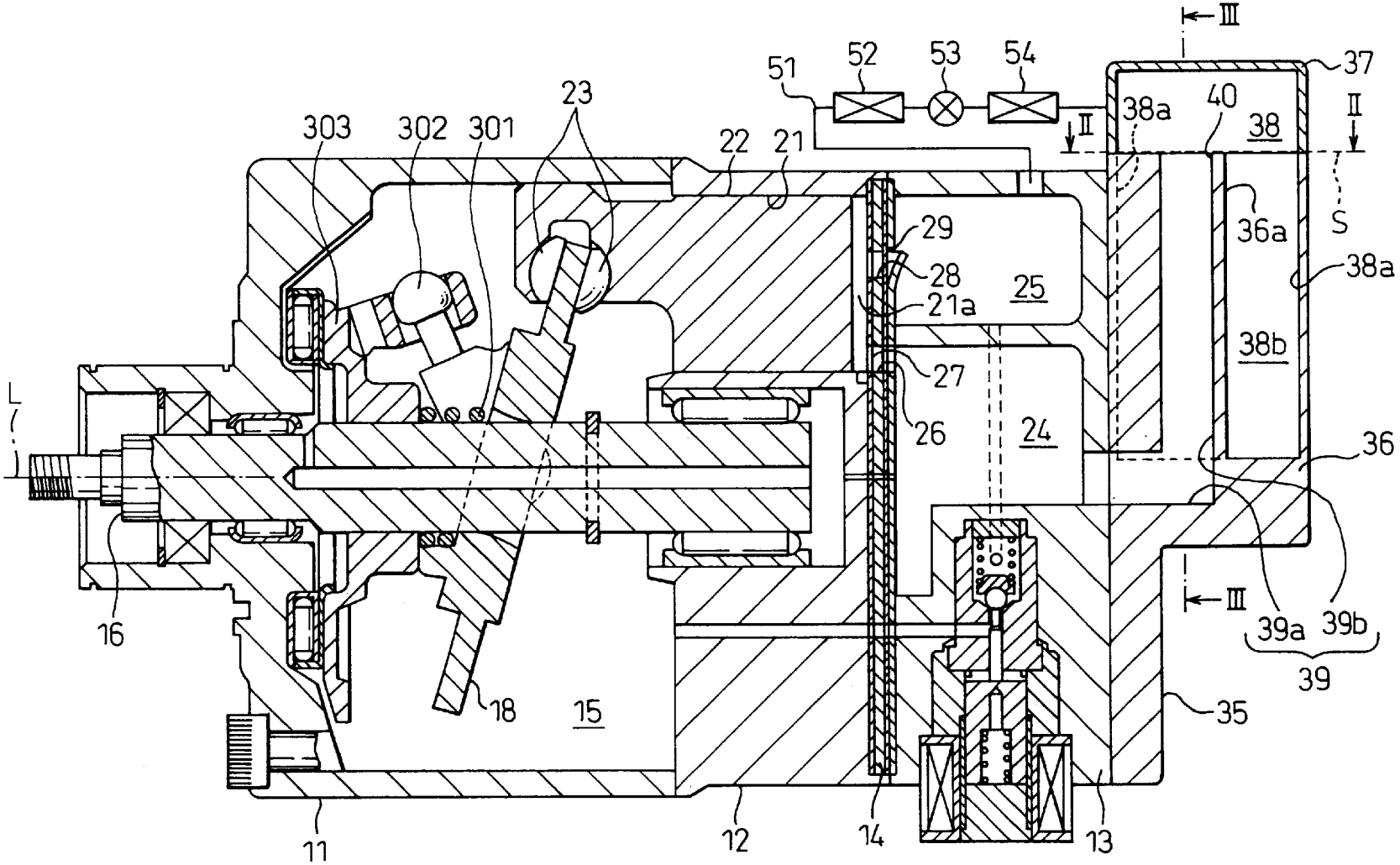
FIG. 1 is a side sectional view of a compressor according to an embodiment of the present invention.

As illustrated in FIG. 1, a front housing 11 is fixedly secured to the front end of a cylinder block 12. A rear housing 13 is fixedly secured to the rear end of the cylinder block 12 via a valve/port assembly 14. A crank chamber 15 is defined in and surrounded by the front housing 11 and the cylinder block 12. The front housing 11, the cylinder block 12 and the rear housing 13 constitute a compressor housing.

A drive shaft 16 is supported by the front housing 11 and the cylinder block 12 for rotation and extends through the crank chamber 15. The drive shaft 16 is coupled to a vehicle engine (not shown) used as an external drive source via a clutch mechanism such as a magnetic clutch also not shown. Accordingly, the drive shaft 16 is driven to rotate when the vehicle engine is operated and the clutch mechanism is turned ON.

Figure 3:
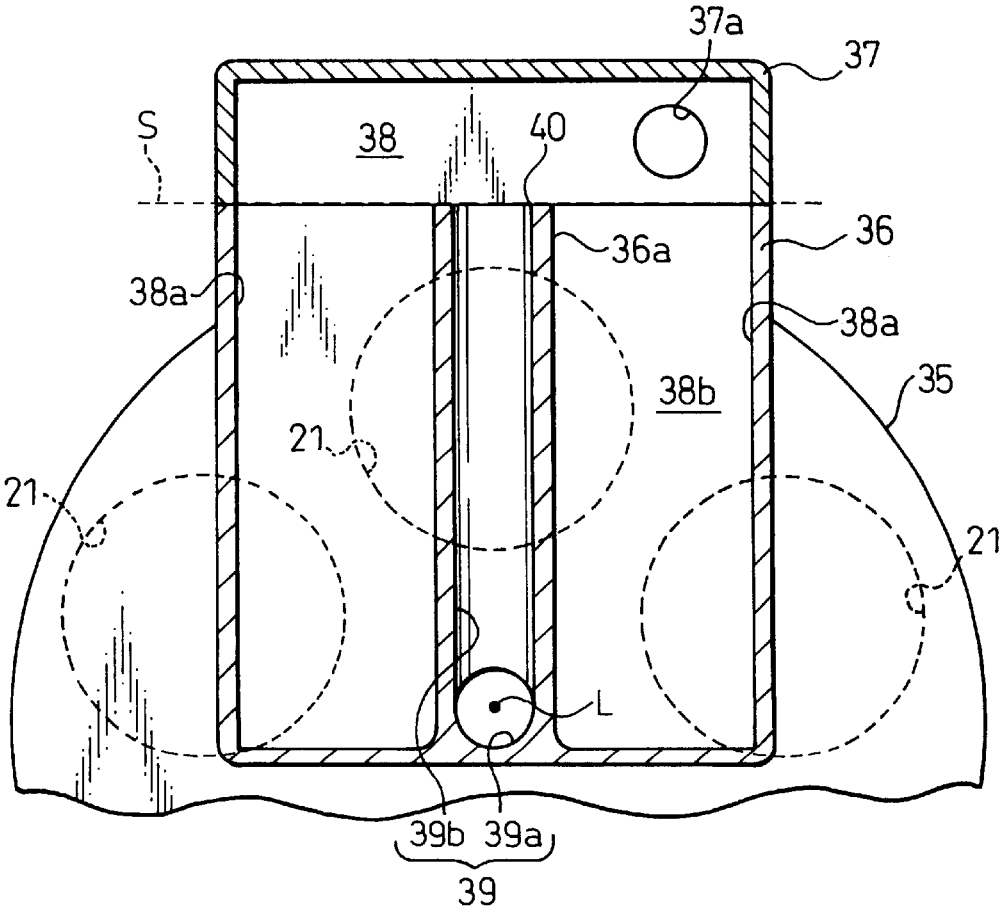
FIG. 3 is a sectional view taken along the line III—III in FIG. 1.

A swash plate 18 is coupled to the drive shaft 16 for rotation therewith in the crank chamber 15. Cylinder bores 21 are formed in and through the cylinder block 12. As shown in FIG. 3 by a dotted line, the cylinder bores 21 are equidistantly arranged around an axis L. A single-head type piston 22 is accommodated in the respective cylinder bore 21. A compression chamber 21*a* is defined in the cylinder bore 21 between a tip end surface of the piston 22 and a front end surface of the valve/port assembly 14. The piston 22 is engaged with the outer peripheral portion of the swash plate 18 via shoes 23 and reciprocated forward and backward within the cylinder bore 21 due to the rotational motion of the swash plate 18.

A suction chamber 24 is defined in the central region of the rear housing 13, and a discharge chamber 25 is defined outside the suction chamber 24 in the rear housing 13. The suction chamber 24 and the discharge chamber 25 are disposed adjacent to the compression chambers 21*a* via the valve/port assembly 14, respectively. The valve/port assembly 14 is provided with suction ports 26 connecting the compression chambers 21*a* to the suction chamber 24, suction valves 27 for opening/closing the suction ports 26, discharge ports 28 connecting the compression chambers 21*a* with the discharge chamber 25, and discharge valves 29 for opening/closing the discharge port 28.

A coolant gas in the suction chamber 24 is sucked into the compression chamber 21*a* via the suction port 26 and the suction valve 27 during the backward motion of the piston 22. The coolant gas sucked in the compression chamber 21*a* is compressed to a predetermined pressure during the forward motion of the piston 22, and thereafter, discharged via the discharge port 28 and the discharge valve 29 to the discharge chamber 25.

In the above-mentioned compressor, the suction chamber 24 and the discharge chamber 25 are connected to each other through an external coolant circuit 51. The external coolant circuit 51 is provided with a condenser 52, an expansion valve 53 and an evaporator 54. The compressor is located in a refrigeration circuit for the vehicle air-conditioner at a position lower than the condenser 52, the expansion valve 53 and the evaporator 54. This is because the compressor is driven by a vehicle engine disposed in a lower region of a vehicle body.

Next, a suction muffler structure of this embodiment will be described.

Figure 2:
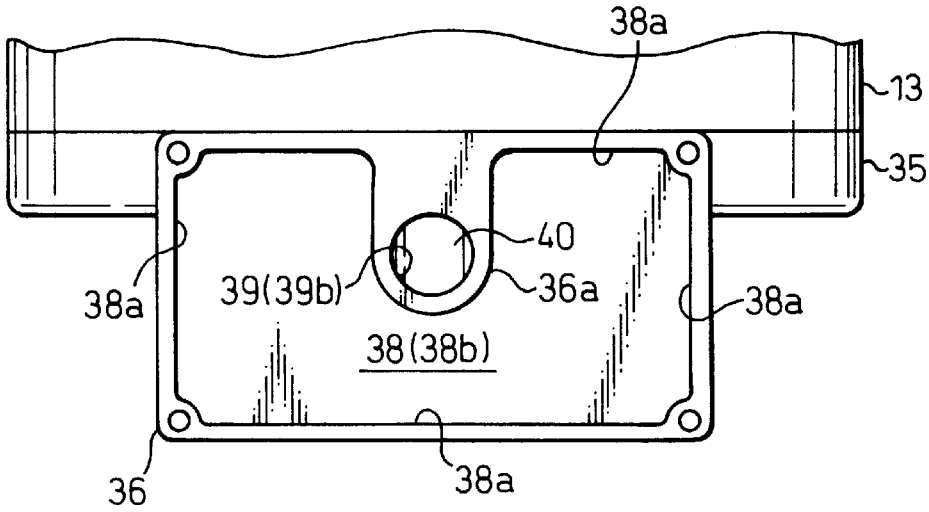
FIG. 2 is a sectional view taken along the line II—II in FIG. 1.

As shown in FIGS. 1 to 3, a muffler housing 35 is manufactured by casting or forging, and fixedly secured to the rear end of the rear housing 13. The front housing 11, the cylinder block 12, the rear housing 13 and the muffler housing 35 are fastened together by through-bolts (not shown) extending in the axial direction L. A muffler-forming section 36 is formed generally in an upper half region of the muffler housing 35, so as to rearwardly bulge from the rear end surface of the lower half region of the muffler housing 35. A muffler cover 37 is fixedly secured to the upper end of the muffler-forming section 36. A muffler chamber 38 is formed by the muffler-forming section 36 and the muffler cover 37 so as to extend partly in the muffler-forming section 36 and partly in the muffler cover 37. The muffler chamber 38 is coupled to the external coolant circuit 51 via a through-hole 37*a* formed in the muffler cover 37 at a laterally shifted position.

A passage-forming section 36*a* is of a tubular shape and is formed on and integrally with the inner bottom wall of the muffler chamber 38 in the muffler-forming section 36. The passage-forming section 36*a* extends upward from the inner bottom surface of the muffler chamber 38 in the direction crossing the axis L. The muffler-forming section 36 has an outer wall having inner side surfaces 38*a* to partly form the muffler chamber 38, and the passage-forming section 36*a* is merged and supported by one of the inner side surfaces 38*a* of the muffler chamber 38, whereby the passage-forming section 36*a* is strengthened, compared with the case where only a base portion of the passage-forming section would be supported by the muffler-forming section 36, for example. The upper end of the passage-forming section 36*a* is as high as the parting line S between the muffler-forming section 36 and the muffler cover 37, and does not extend upper beyond the parting line S (does not project into a space in the muffler cover 37 in the muffler chamber 38).

A suction passage 39 connects the suction chamber 24 to the muffler chamber 38. The suction passage 39 is constituted by a first passage 39*a* and a second passage 39*b* extending perpendicular to each other. The first passage 39*a* is formed in the rear housing 13 and the muffler housing 35 at a position of the axis L, leading to the suction chamber 24. The second passage 39*b* is formed in the passage-forming section 36*a* on an axis thereof. The second passage 39*b* opens at an upper end thereof, which has a horizontal surface, to the muffler chamber 38 and defines an inlet port 40 from the muffler chamber 38 to the suction passage 39. In other words, the inlet port 40 from the muffler chamber 38 to the suction passage 39 is located in the muffler chamber 38 on the parting line S between the muffler-forming section 36 and the muffler cover 37, whereby a lower region of the muffler chamber 38 beneath parting line S is located beneath the inlet port 40, which region occupies half the volume, or more, of the muffler chamber 38 (and is located in the muffler-forming section 36; hereinafter referred to as a liquid-storage space 38*b*).

A coolant gas coming from the external coolant circuit 51 flows into the suction chamber 24 via the through-hole 37*a*, the muffler chamber 38 and the suction passage 39 and is subjected to the above-mentioned compression cycle. The muffler chamber 38 has a function for enlarging a sectional area of the passage of coolant gas sucked from the external coolant circuit 51 to the suction chamber 24, between the through-hole 37*a* and the suction path 39. A pressure pulsation of the sucked coolant gas is damped by the expansion type muffler action of the muffler chamber 38, whereby it is possible to reduce vibration and noise generated in the piping of the external coolant circuit 51 due to this pressure pulsation.

In, this regard, the above-mentioned compressor is disposed at a position lower than the external coolant circuit 51. Accordingly, when the vehicle is stopped (also the compressor is stopped), the liquid coolant in the external coolant circuit 51 flows into the compressor due to the height difference. The liquid coolant from an evaporator 54 of the external coolant circuit 51 flows into the muffler chamber 38 via the through-hole 37*a* and is stored in the liquid-storage space 38*b* until it reaches the parting line S, i.e., the inlet port 40 of the suction passage 39, whereby the liquid coolant does not move into the suction chamber 24. If the liquid coolant of a volume more than that of the liquid-storage space 38*b* has been stored whereby a surface level of the liquid coolant exceeds the parting line S, the overflowing coolant moves into the suction chamber 24 via the suction passage 39. If the vehicle is stopped for a long period, the suction chamber 24, the muffler chamber 38 and the suction passage 39 may be filled with the liquid coolant at the time at which the compressor is to be operated again.

If the compressor is operated again in such a state, the liquid coolant in the suction chamber 24 is sucked into the compression chamber 21*a* in the liquid compression state and discharged to the discharge chamber 25. If the liquid coolant in the suction chamber 24 sucked into the compression chamber 21*a,* the liquid coolant in the muffler chamber 38 moves via the suction passage 39 to the suction chamber 24 in proportion to the amount of the sucked liquid coolant. Accordingly, a surface level of the liquid coolant in the muffler chamber 38 gradually lowers. When the compressor is operated, a coolant gas from the evaporator 54 flows into the muffler chamber 38, but is inhibited from moving into the suction chamber 24 because the liquid coolant blocks the inlet port 40 of the suction path 39.

When the surface level of the liquid coolant in the muffler chamber 38 becomes lower than the parting line S, the inlet port 40 of the suction passage 39 directly opens to the coolant gas existing in the upper region of the muffler chamber 38. Then, the coolant moving from the muffler chamber 38 into the suction chamber 24 becomes a mixture of gas/liquid phases, and then gradually a gas phase, whereby the compression chamber 21*a* is released from the liquid compression state. The liquid coolant left in the liquid-storage space 38*b* is gasified by heat generated by the vehicle engine and the compressor and moves into the suction chamber 24 in a gas phase.

The embodiment described above has the following effects.

Figure 6:
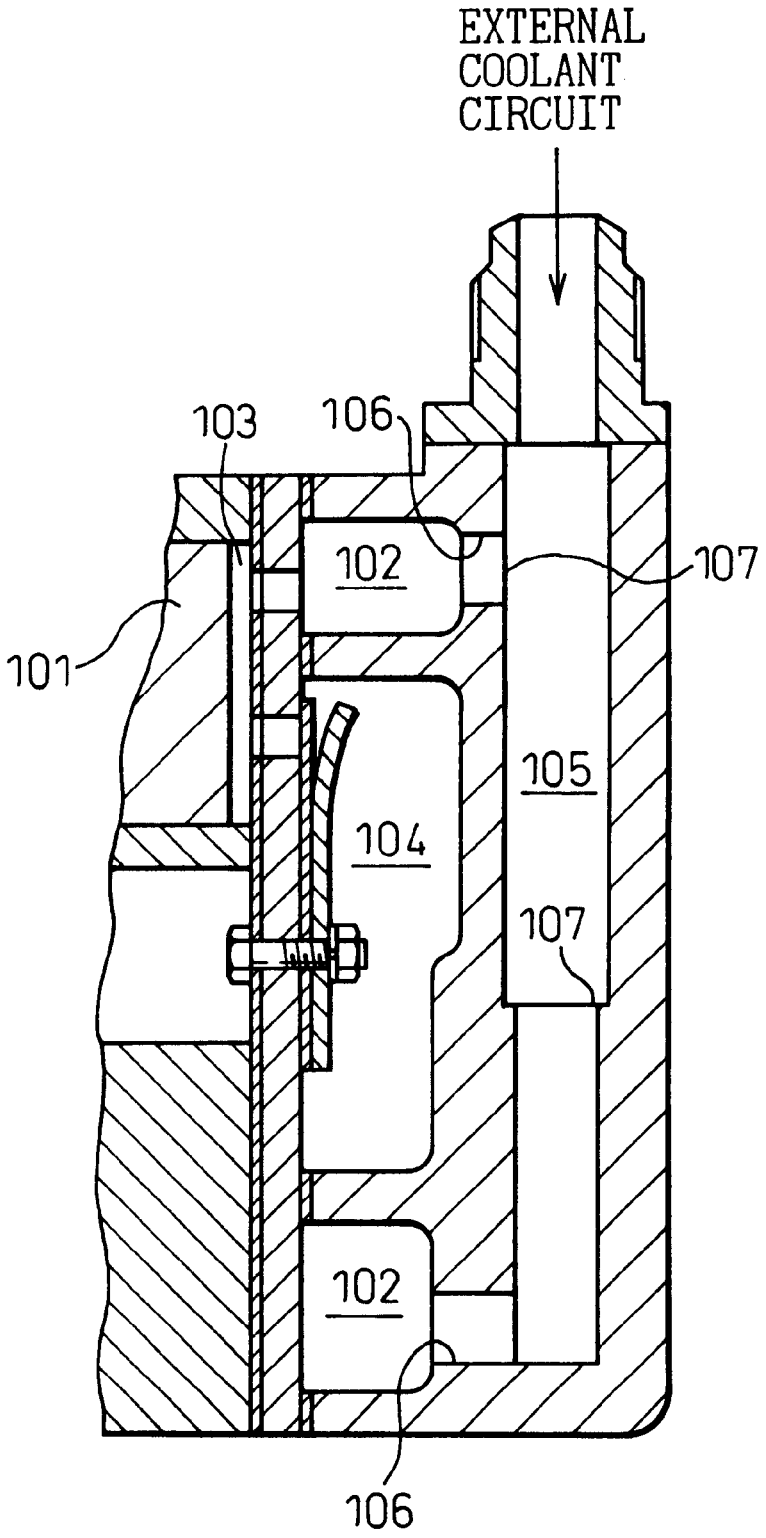
FIG. 6 is a sectional view illustrating a prior art of the suction muffler structure.

(1) As stated above, the liquid coolant in the liquid-storage space 38*b* in the muffler chamber 38 will scarcely move into the suction chamber 24 in the liquid phase, whereby the liquid compression state is promptly overcome, compared with the prior art shown in FIG. 6 wherein all the liquid coolant into the muffler chamber 38 moves into the suction chamber 24 in the liquid phase. Accordingly, it is possible to reduce the vibration and noise accompanying the liquid compression.

In this regard, the liquid coolant may flow into the muffler chamber 38 even during the operation of the compressor, if the liquid coolant is not completely evaporated in the evaporator 54, for example, due to a lower cooling load. The liquid coolant flowing into the muffler chamber 38, however, is temporarily stored in the liquid-storage space 38*b,* and it is then gasified by heat and moves into the suction chamber 24 in a gas phase. Therefore, it is possible to prevent liquid compression from occurring and, thus, to avoid the generation of vibration and noise accompanying liquid compression. In this case, as shown in FIG. 3, it is important that the inlet port 40 from the muffler chamber 38 to the suction passage 39 and the through-hole 37*a* are spaced apart from each other in the horizontal direction so that the liquid coolant in the external coolant circuit 51 flows directly down from through-hole 37*a* to the inlet port 40. This is also true even in the case where a stopping time of a vehicle is short and the amount of liquid coolant flowing from external coolant circuit 51 is too small to overflow the liquid storage space 38*b*.

(2) The forming section 36*a* extends in the muffler chamber 38 to the parting line S, and the inlet port 40 from the muffler chamber 38 to the suction passage 39 is arranged in the vicinity of the parting line S. Therefore, a larger volume (more than a half) of the muffler chamber 38 can be used as the liquid-storage space 38*b,* whereby the effects described in the preceding paragraph (1) are more efficiently achievable.

If the passage-forming section 36*a* extends upward above the parting line S, the volume of the liquid-storage space 38*b* may further increase. However, such a passage-forming section 36*a* (a structure for forming the inlet port 40) defined by exceeding the parting line S disturbs the grinding operation when the parting surface of the muffler-forming section 36 to be in contact with the muffler cover 37 is ground, and deteriorates the workability thereof. To solve this problem, a passage-forming section 36*a* having a height exceeding the parting line S may be manufactured separately from the muffler-forming section 36 and then fixed to the muffler-forming section 36 after the parting surface has been ground. In such a case, however, the preparation of the passage-forming section 36*a* separately from the muffler-forming section 36 causes an increase in the number of parts and the man-hours necessary for the assembly of the compressor.

(3) For instance, as shown in another embodiment in FIG. 4 described later, if the inlet port 40 from the muffler chamber 38 to the suction passage 39 opens laterally, the inlet port 40 involves a height difference in correspondence with the diameter thereof, which reduces the volume of the liquid-storage space 38*b*. Contrarily, according to this embodiment, the second passage 39*b* opens, to the muffler chamber 38, at the upper end surface defining a horizontal plane of the passage-forming section 36*a*. In other words, the inlet port 40 of the suction passage 39 opens upward in the muffler chamber 38. Accordingly, there is no height difference in the inlet port 40, resulting in a liquid-storage space 38*b* of a larger volume.

(4) The muffler housing 35 is manufactured separately from the housing parts 11 to 13 of the compressor. Accordingly, the degree of freedom in the shape of the muffler housing 35 increases whereby it is possible, for example, to easily shape the passage-forming section 36 within the muffler chamber to be integral with the muffler housing 35 as described above.

(5) In addition to the matter (4) described above, the muffler housing 35 is fixedly secured to the housings 11 to 13 for the compressor. The compressor integral with a suction muffler structure is easily handled and is readily assembled into a vehicle.

It should be noted that the present invention can be modified in the following manner without departing from the sprit of the present invention.

Figure 4:
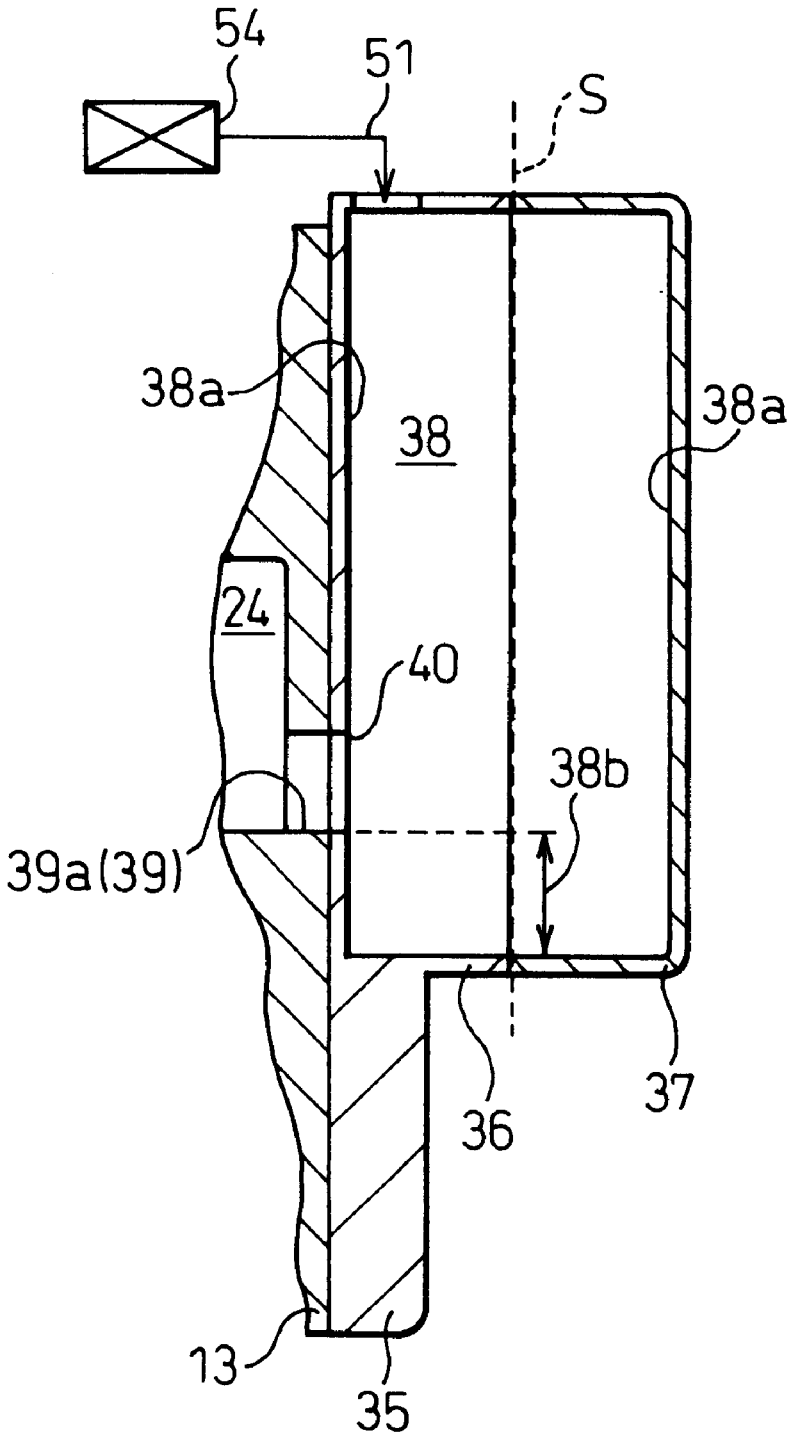
FIG. 4 is a sectional view illustrating another embodiment of the suction muffler structure.

As shown in FIG. 4, the muffler chamber 38 of the above-mentioned embodiment may be displaced to a lower region so that the first passage 39*a* is directly connected to the muffler chamber 38. In this case, the inlet port 40 from the muffler chamber 38 to the first path 39*a* (suction passage 39) opens in the inner side wall surface 38*a,* and the liquid-storage space 38*b* is defined in a region of the muffler chamber 38 lower than the inlet port 40, as indicated by a double-headed arrow. Accordingly, it is possible to achieve the same effects as described in the matter (1) of the above-mentioned embodiment. Also, the inlet port 40 opens to the muffler chamber 38 in front of the parting line S (located in the muffler-forming section 36), whereby the grinding operation of the muffler-forming section 36 is not disturbed by the structure for forming the inlet port 40 (inner side wall surface 38*a*) when the parting surface to be in contact with the muffler cover 37 is ground. Further, in the system shown in FIG. 4, the muffler cover 37 is fixedly secured to the rear end of the muffler-forming section 36. Thereby, it is possible to prevent the compressor from becoming larger in size in the direction perpendicular to the axis L due to the muffler cover 37.

Figure 5:
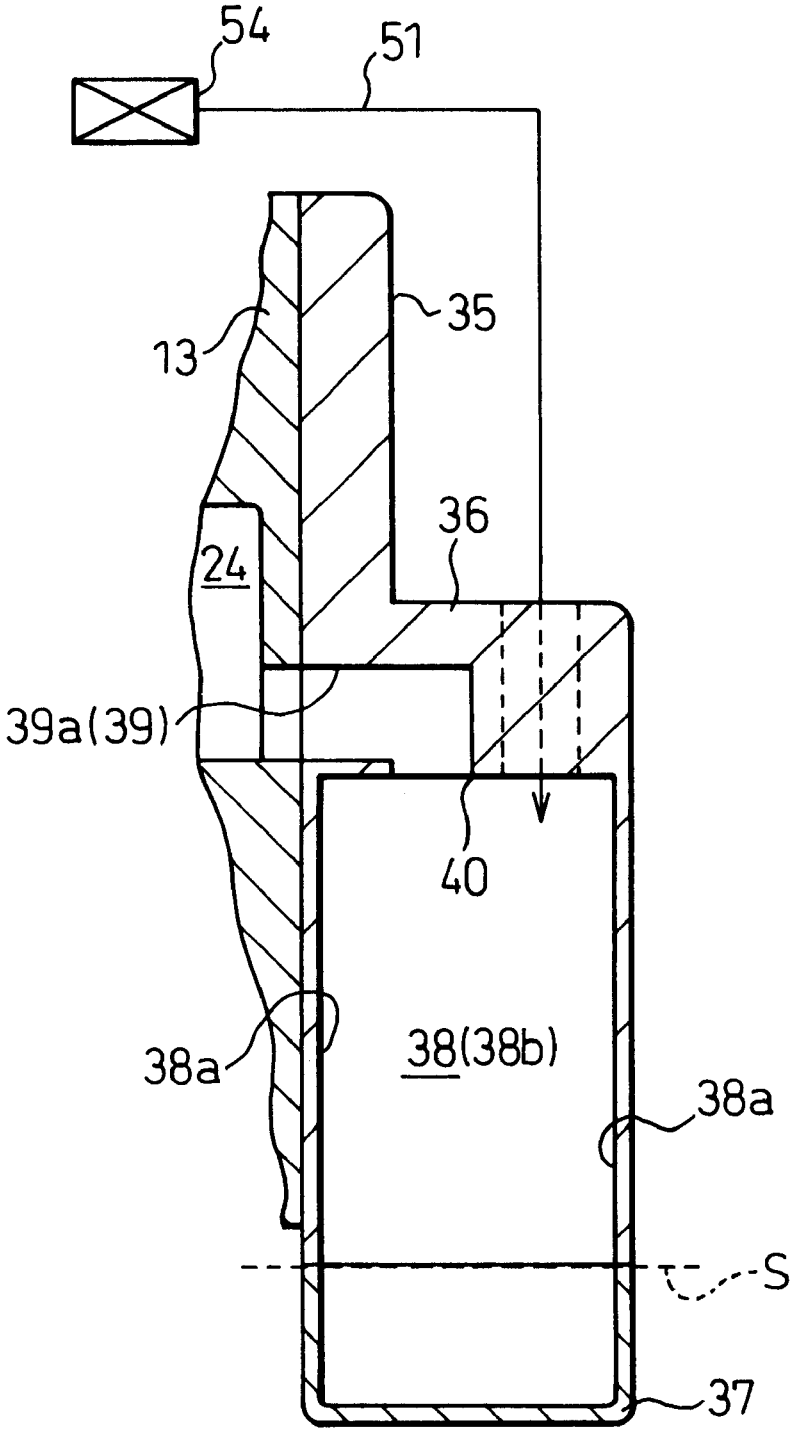
FIG. 5 is a sectional view illustrating a further embodiment of the suction muffler structure.

As shown in FIG. 5, the muffler-forming section 36 may be formed in the rear end surface of the muffler housing 35 so that a generally lower half thereof is bulged outward. The muffler cover 37 is fixedly secured to the lower end of the muffler-forming section 36. The first passage 39*a* extends to a position above the muffler chamber 38, and the inlet port 40 from the muffler chamber 38 to the first path 39*a* (suction passage 39) opens downwardly at the inner top surface of the muffler chamber 38 defining a horizontal plane. Accordingly, the area of the muffler chamber 38 beneath the inlet port 40, i.e., a whole area of the muffler chamber 38 defines the liquid-storage space 38*b*. As a result, a further larger liquid-storage space 38*b* is obtainable to more quickly release the compressor from the liquid compression state. The inlet port 40 opens to the muffler chamber 38 in front of the parting line S (located in the muffler-forming section 36), whereby the grinding operation of the muffler-forming section 36 is not disturbed by the structure for forming the inlet port 40 (inner top surface of the muffler chamber 38) when the abutment surface to be in contact with the muffler cover 37 is ground.

The rear housing 13 may be structured so that it also plays the role of the muffler housing 35. In other words, the muffler-forming section 36 may be provided in the rear housing 13. Thereby, it is possible to reduce the number of parts composing the compressor.

The passage-forming section 36*a* may be formed as a tubular body separately from the muffler-forming section 36 (muffler housing 35). Thereby, the degree of freedom for designing the suction path 39 increases.

The passage-forming section 36*a* may be formed to exceed the parting line S (into a space in the muffler cover 37). Thereby, it is possible to obtain the liquid-storage space 38*b* of a larger volume.

The technical idea behind the above embodiments will be described below.

(1) A suction muffler structure wherein the liquid-storage space 38*b* occupies half the volume of the muffler chamber 38. According to this arrangement, the effect for reducing the vibration and noise accompanying the liquid compression is facilitated.

(2) A suction muffler structure wherein the muffler housing 35 is manufactured separately from the housing parts 11 to 13 of the compressor. According to this arrangement, the degree of freedom for designing the muffler housing 35 is enhanced.

(3) A suction muffler structure wherein the muffler housing 35 is fixedly secured to the housing parts 11 to 13 of the compressor.

According to this arrangement, the compressor, into which the suction muffler structure is integrated, is easily handled and readily incorporated into a vehicle.

According to the present invention, the liquid coolant in the liquid-storage space in the muffler chamber scarcely moves into the suction chamber in the liquid phase, whereby it is possible to quickly overcome the liquid compression state which is caused in the prior art shown in FIG. 6 wherein almost all the liquid coolant in the muffler chamber is displaced to the suction chamber. Accordingly, vibration and noise accompanying liquid compression can be reduced.

What is claimed is:

1. A compressor comprising:

a housing having a compression chamber and a suction chamber defined adjacent to each other in said housing;

a movable member associated with said compression chamber so that a coolant gas is sucked from the suction chamber into the compression chamber, compressed in the compression chamber and discharged from the compression chamber; and a suction muffler structure, said suction muffler structure comprising:

a muffler chamber provided between the suction chamber and an external coolant circuit;

a suction passage connecting the muffler chamber to the suction chamber, said suction passage having an inlet from said muffler chamber; and said muffler chamber having a liquid-storage space formed in a region in the muffler chamber lower than said inlet;

wherein a through-hole formed in said muffler chamber receives a flow of coolant from said external coolant circuit;

wherein said through-hole is positioned at the same level or higher in the muffler chamber than said inlet;

wherein said compressor is positioned at a lower position in an engine room than said external coolant circuit, such that when the compressor is stopped, any liquid coolant in said external coolant circuit flows into said liquid storage space of said compressor due to the height difference thereby reducing any vibration and noise that may accompany liquid compression.

2. A compressor as defined by claim 1, wherein the muffler chamber is formed, by a muffler housing attached to said housing of the compressor and a muffler cover fixedly secured to the muffler housing at a parting line, so as to extend partly in said muffler housing and partly in said muffler cover; the suction passage being formed in one of the muffler housing and the muffler cover to extend to the muffler chamber; said inlet being disposed at a position not exceeding the parting line between the muffler housing and the muffler cover.

3. A compressor as defined by claim 1, wherein the inlet from the muffler chamber to the suction passage opens upward or downward.

4. A compressor as defined by claim 2, wherein said muffler housing has an outer wall to partly form said muffler chamber and a tubular wall in said outer wall to form said suction passage.

5. A compressor as defined by claim 1, wherein said liquid storage space occupies at least half of said muffler chamber.

6. A compressor as defined by claim 1, wherein said through-hole is located above and laterally off-set from said inlet.

7. A compressor as defined by claim 1, wherein said through-hole and said inlet are open downwardly at an inner top surface of said muffler chamber defining a horizontal plane and the whole area of said muffler chamber beneath said inlet defines said liquid storage space.

8. A compressor comprising:

a housing having a compression chamber and a suction chamber defined adjacent to each other in said housing;

a movable member associated with said compression chamber so that a coolant gas is sucked from said suction chamber into said compression chamber, compressed in said compression chamber and discharged from said compression chamber to an external coolant circuit; and a suction muffler structure, said suction muffler structure comprising:

a muffler housing attached to said housing of said compressor;

a muffler cover fixedly secured to said muffler housing at a parting line;

a muffler chamber formed by said muffler housing and said muffler cover, said muffler chamber extending partly into said muffler housing and partly into said muffler cover, said muffler chamber being provided between said suction chamber and said external coolant circuit;

a suction passage formed in one of said muffler housing and said muffler cover to connect said muffler chamber to said suction chamber;

an inlet to said suction passage from said muffler chamber, said inlet being disposed at a position not exceeding said parting line between said muffler housing and said muffler cover;

a liquid-storage space formed in a region in said muffler chamber lower than said inlet;

a through-hole formed in said muffler chamber for receiving a flow of coolant from said external coolant circuit;

wherein said through-hole is positioned at the same level or higher in said muffler chamber than said inlet;

wherein said compressor is positioned at a lower position in an engine room than said external coolant circuit, such that when said compressor is stopped, any liquid coolant in said external coolant circuit flows into said liquid storage space of said compressor due to the height difference thereby reducing any vibration and noise that may accompany liquid compression.

9. A compressor as defined by claim 1, wherein all of said coolant from said external coolant circuit flows through said muffler chamber.

10. A compressor as defined by claim 8, wherein said muffler chamber is arranged on the outside of said housing and is attached to a wall of said housing.

* * * * *